US005831201A

United States Patent [19]

Andersson et al.

[11] Patent Number: 5,831,201

[45] Date of Patent: Nov. 3, 1998

[54] RAMMING SYSTEM

[75] Inventors: Par Andersson, Linghem; Sten Hallqvist, Vingaker, both of Sweden

[73] Assignee: Bofors AB, Karlskoga, Sweden

[21] Appl. No.: 809,818

[22] PCT Filed: Oct. 13, 1995

[86] PCT No.: PCT/SE95/01180

§ 371 Date: Jun. 2, 1997

§ 102(e) Date: Jun. 2, 1997

[87] PCT Pub. No.: WO96/12153

PCT Pub. Date: Apr. 25, 1996

[30] Foreign Application Priority Data

Oct. 13, 1994 [SE] Sweden ..... 9403476

[51] Int. Cl.[6] ..... F41A 9/00

[52] U.S. Cl. ..... 89/45; 89/47

[58] Field of Search ..... 89/45, 47

[56] References Cited

U.S. PATENT DOCUMENTS 4,457,209 7/1984 Scheurcih et al. ..... 89/45

4,495,853 1/1985 Gottwaldt ..... 89/46

5,347,911 9/1994 Hallqvist ..... 89/45

5,604,327 2/1997 Skoglund et al. ..... 89/46

*Primary Examiner*—J. Woodrow Eldred

*Attorney, Agent, or Firm*—Pollock, Vande Sande & Priddy

[57] ABSTRACT

A method and an apparatus for loading artillery guns intended for non-cartridge ammunition is provided. The loading is done by a pair of flick rammers including a first flick rammer for shells and a second flick rammer for propellant charges. Each of the flick rammers is positioned at an end position where the flick rammers are loaded with the shell and propellant charge, respectively, and in which the gun can recoil between the flick rammers. After the first flick rammer is loaded, it is moved towards the second flick rammer into a position in which the shell in the first flick rammer is in line with a gun barrel. The first flick rammer is then activated to move the shell into the gun barrel. The flick rammers are then jointly displaced in an opposite direction until the first flick rammer is in its end position and the propellant charges in the second flick rammer are in line with the gun barrel. The second flick rammer is then activated moving the propellant charges into the gun barrel and after this the second flick rammer is returned to its end position.

7 Claims, 4 Drawing Sheets

RAMMING SYSTEM

FIELD OF THE INVENTION

The present invention relates to a method and a device for ramming shells and propellant charges in artillery guns of the type which are loaded with non-cartridged ammunition, i.e. those in which the shell and propellant charge are rammed separately.

BACKGROUND ART

Modern artillery tactics presuppose extremely high loading speeds, even for heavier guns, and at the same time entail the need for rapid changes in the gun elevation and in the size of the propellant charges between the different shots in a salvo. This is of course done in an attempt to get as many shells as possible to hit the target area as close upon each other as possible, and this is achieved by firing the various shells in one salvo towards the target area along trajectories of different heights. In addition, the increased maximum firing ranges of the guns mean that there is an ever greater number of different propellant charges to alternate between. The most flexible type of propellant charge available at present consists of a variable number of charge modules with combustible and essentially stiff outer casings. These charge modules are found in at least two basic types, of which one type is designed so that the various modules can be connected together to form larger or smaller charges. However, not even these connected charge modules have the same stability as a unit charge of an older type, and charges made up of such charge modules are therefore more difficult to ram automatically than the completely stiff unit charges with metal, plastic or combustible casings. In the alternative case, where the charge modules above are not connected to each other, the difficulties increase to a corresponding extent.

The most urgent problem currently facing gun constructors has therefore been to develop a novel loading system which is sufficiently fast to satisfy modern artillery technology and which at the same time is of sufficient flexibility that it becomes possible to exploit the abovementioned module charges fully and, in so doing, to benefit from all the advantages thereof.

A main component in the general loading system has been available for some years now, namely the so-called flick rammer with which it is possible to effect a very rapid ramming of larger shells at high elevations. As the name suggests, the flick rammer is designed to throw shells and/or propellant charges at high speed for ramming in the gun. However, the flick rammer is chiefly used today for shells and completely stiff unit charges, for example of the type with combustible casings or discardable casings made of plastic or metal. On the other hand, it has hitherto been difficult to get the flick rammer to function satisfactorily with module charges of the abovementioned types. It is also true that flick rammers, if they are to function without error, depend on an extremely precise alignment in relation to the gun barrel.

SUMMARY OF THE INVENTION

The present invention relates to a loading system which satisfies all the abovementioned requirements applying at present to a modern loading system of this type, that is both as regards to rapidity as well as to flexibility and functional reliability.

The invention is based on the use of a pair of cooperating flick rammers, one of which is intended for ramming the shells, and the other for ramming the propellant charges. For the necessary alignment of the rammers to be sufficiently exact, they are mounted in a frame which forms part of the gun elevation system and in which they can be displaced sideways from each of their outermost positions on either side of the gun. When the rammers are situated in their respective outermost positions, in which they are also supplied with new shells or propellant charges by means of members which do not form part of the present invention, the gun recoil system can pass between them.

According to the present invention, accuracy is now achieved between the supporting loading troughs of the rammers and the shells or propellant charges included therein, by virtue of the fact that the frame included therein follows the elevation of the gun and that the rammers can only be displaced in parallel inside the frame. The rapidity of the whole loading sequence is obtained by the following. Once the loading trough of the flick rammer intended for ramming the shells and the loading trough of the flick rammer intended for ramming the propellant charges have been supplied with shells or propellant charges, respectively, the flick rammer intended for ramming the shells is guided towards the propellant rammer's side of the frame. The propellant rammer is forced out towards its outermost position at the same time as the shell rammer comes into the ramming position with the shell in line with the gun barrel, in which position the flick rammer for the shells is activated. After which, the two rammers are together displaced sideways in the frame until the shell rammer has reached its outermost position and the propellant rammer has arrived at the ramming position in line with the gun barrel, in which position its flick rammer is activated. After which, the propellant rammer is returned to the original position for supply of a new propellant charge, at the same time as a new shell is supplied to the shell rammer which is thus already situated at its outermost position. With the two rammers in their respective outermost positions, the gun is ready for firing.

The loading trough in the flick rammer intended for the shell can be connected rigidly to the main part of the rammer, with the shell being accelerated upon ramming to ramming speed in the loading trough and, in accordance with present-day technology, being thrown over and into the loading opening of the gun for ramming in the ramming position intended for this purpose in the gun barrel. In contrast, the propellant charge is to be accelerated, in accordance with the invention, up to the necessary ramming speed together with the loading trough which can thus be displaced axially into the loading opening of the gun barrel, by means of which it has been possible to flick-ram those propellant charges which consist of a number of separate, but consecutive and closely adjoining charge modules of the previously mentioned type.

BRIEF DESCRIPTION OF THE DRAWINGS

The invention has been defined in the patent claims which follow and it will now be described in somewhat greater detail with reference to the attached figures, in which:

DETAILED DESCRIPTION OF THE INVENTION

Figure 1:
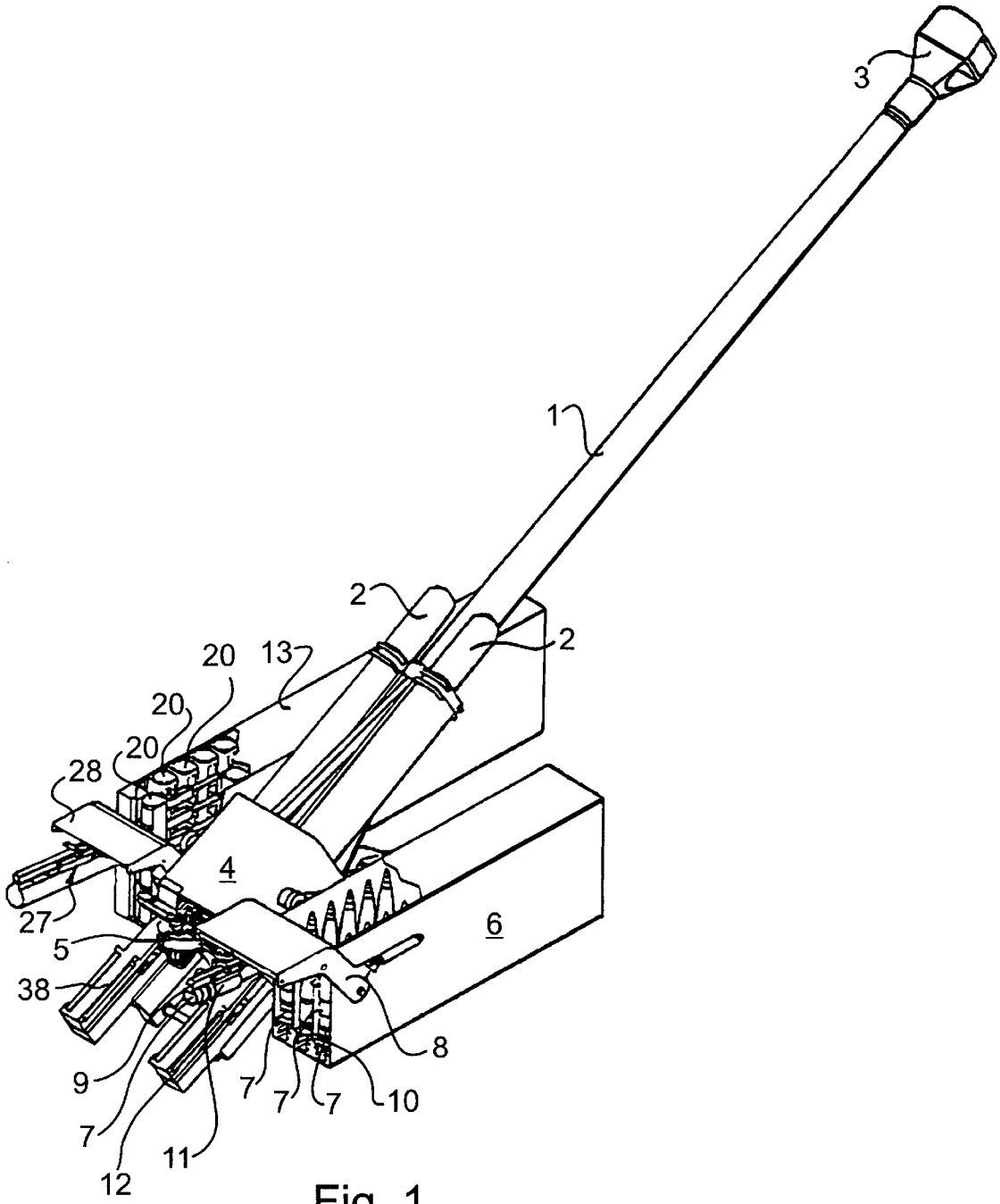
FIG. 1 shows an oblique projection, in partial cross-section, of an artillery gun designed according to the invention, but with the subcarriage omitted for the sake of clarity.

The artillery gun shown in FIG. 1 includes the barrel 1 with recoil buffers and recuperator 2, muzzle brake 3, gun cradle 4 and a conventional screw mechanism 5 which is shown in the open position in the figure. The figure also shows some of the components which are important for the functioning of the finished gun, such as the shell magazine 6 which, in the example shown, holds shells 7 of three different main types which are arranged in three different rows and which can be fed out individually. Of course, the number of rows of shells is chiefly a question of space. There is a pivotable cradle 8 arranged on the shell magazine 6. A shell pendulum 9 is suspended pivotably and displaceably in the cradle 8. The shell pendulum 9 can thus be pivoted in from the position shown in the figure, where it lies essentially horizontally, to a vertical position immediately adjacent to the delivery end 10 of the magazine 6. By means of the inherent sideways displacement function, it can additionally be placed directly in front of the shell with which the gun is to be loaded, after which a feeding mechanism built into the magazine 6 is activated so that it feeds the shell to the shell pendulum, where the grabs 11, which form part of the shell pendulum 9 and which are indicated in the figure, take hold of the shell. After which the pendulum is moved out to the horizontal position shown in FIG. 1. The shell pendulum is thereafter moved sideways to a position in line with and above the rammer 12, whereupon the shell pendulum cradle 8 (which is journalled in the gun trunnion center) swings with the shell pendulum to a position which corresponds to the gun elevation, after which the shell can be transferred directly to the flick rammer 12, which also follows the gun elevation, and from which the shell is thereafter rammed once the rammer has been brought fully into alignment with the barrel 1. For transferring both shells and propellant charges from the respective loading pendulum to the respective flick rammer, it may be necessary, in the case of high elevations, to have special members in the form of ejector pistons or an equivalent. However, these are not included in the drawings.

Figure 2:
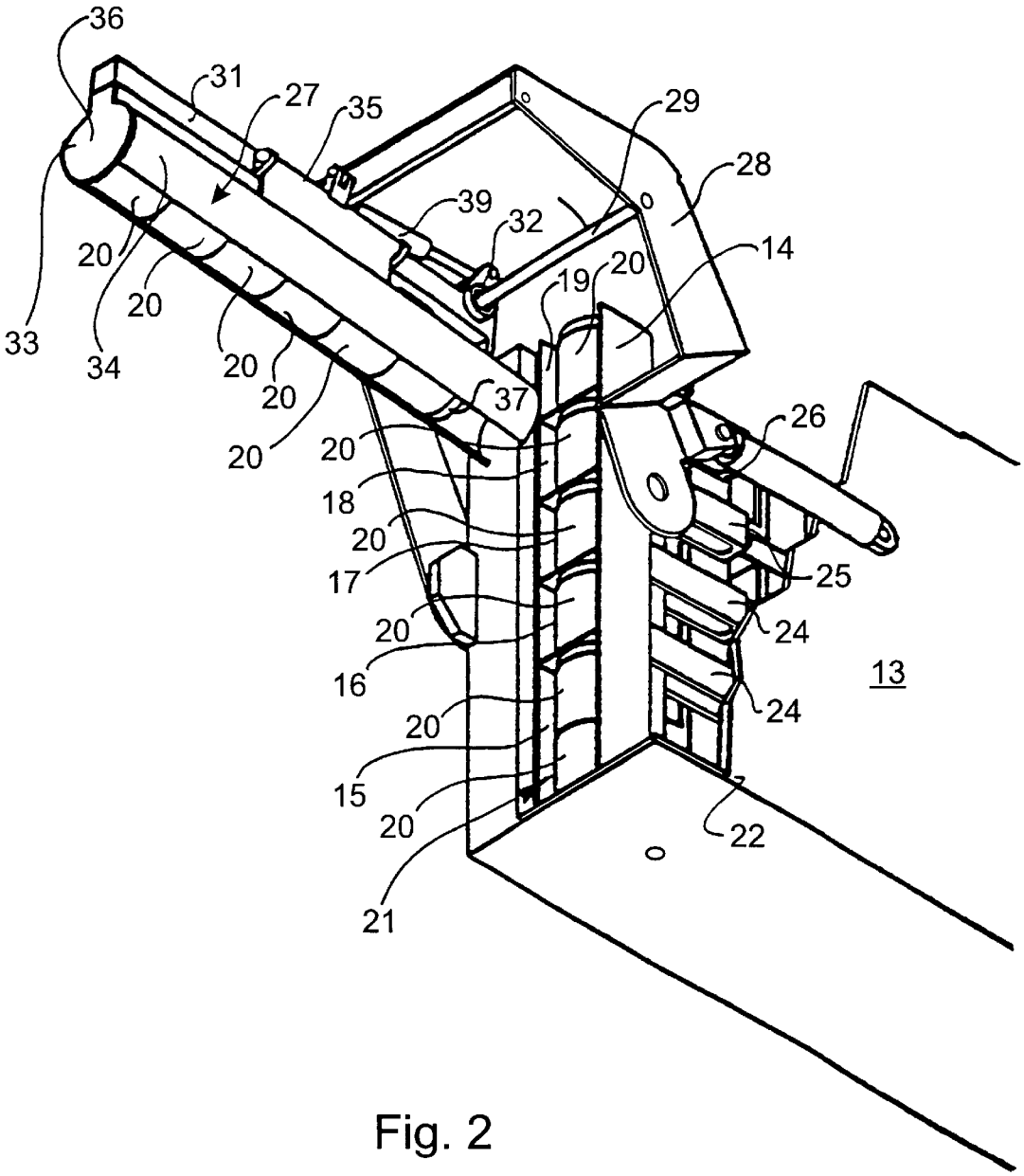
FIG. 2 shows, on a larger scale, an oblique projection, in partial cross-section, of the magazine from which the gun is supplied with propellant charges.

The propellant magazine 13 of the gun is also shown in FIG. 1, but it is shown mainly in FIG. 2. A mechanically displaceable endless chain conveyor runs in the propellant magazine 13, the said chain conveyor consists of several vertical sets of compartments 14 which are hinged together to form a chain. In the figures, these are shown as chutes open on one side. Each one of these sets of compartments or chutes 14 includes a number of compartments 15–19 each initially holding one propellant module, or in the case of the compartment 15 two propellant modules, generally designated by 20 hereinafter. The number of propellant modules in each compartment can of course be varied between one and several, depending entirely on which gun is being considered and on the size of the propellant modules. The sets of compartments 14 are intended to be fed forward successively by the endless chain conveyor to a vertical delivery opening 21 formed in the magazine 13. In this position, all the propellant modules 20 present in the various compartments of the set of compartments can be acted on by ejectors 22–26 which are designed for this purpose, the ejector 22 being hidden in the figure, however, and the ejector 26 being largely hidden.

The intention is that the delivery opening 21 will be supplied, as and when necessary, with new sets of compartments which have all their compartments 15–19 filled with propellant modules 20, and, of these propellant modules, a number adapted for each firing will be displaced by the ejectors 22–26 over to a loading pendulum 27 lowered alongside the delivery opening. The loading pendulum 27 has, on the one hand, a first inherent lowering function 39 which is used for lowering the loading pendulum alongside the delivery opening 21, and, on the other hand, a second lowering function in the form of the cradle 28 which is journalled in the gun trunnion center and in which it is secured and with which it can be lowered to an angle which is adapted to the gun elevation in order to lie, in the same manner as for the shell, in an angle position adapted to its own propellant charge rammer 38 for direct transfer of the propellant charge to the propellant charge rammer 38 which depends for its angle position on the gun elevation.

The loading pendulum is also arranged in the cradle 28 such that it can be displaced sideways along a guide beam 29. The guide beam 29 can consist of a threaded axle which is turned by a motor, hidden in the figure, of suitable type, such as a hydraulic motor, electric motor or the like, and which acts on a freely rotating nut 32 arranged on the loading pendulum. Of course, the threaded axle can also be fixed and the nut rotated in a suitable way. This is to make it possible for the transverse position of the propellant charge pendulum to be aligned relative to the propellant charge rammer 38. When the required number of propellant modules 20 have been transferred to the loading pendulum 27, the endless chain conveyor made up of the sets of compartments 14 is moved one step by turning driven cog wheels. The propellant modules 20 which were not made use of in the previous set of compartments return to the system, while at the same time a full complement of propellant modules corresponding to the maximum loading of the gun is thereafter available once again at the delivery opening 21 for the next loading operation.

The loading pendulum itself is built around a main beam 31 in which the journal 32 for the guide beam 29 is arranged. It also has two long side walls 33, 34 which are adapted to the external form of the propellant modules 20 and which are hinge-journalled and can be opened by means of a common hydraulic piston 35 (see FIG. 1), and a fixed counter-support 36 which is arranged at the end of the loading pendulum and which points downwards when the latter is lowered against the delivery opening 21 of the magazine. Inside the loading pendulum there is additionally a compacting heel 37 which is partly hidden in the figures and which is movable in its longitudinal direction from the end opposite the fixed counter-support 36 towards the latter.

The loading pendulum 27 functions such that when it is first lowered vertically against the delivery opening 21 and its long sides 33, 34 are then opened to a sufficient extent to allow the propellant modules 20 to be supplied to the same, by means of a suitable number of ejectors 22–26 being activated, the desired number of propellant modules 20 are transferred to the loading pendulum 27. As soon as this operation has been carried out, the hydraulic piston 35 is activated and the long sides 33, 34 of the loading pendulum are closed, and during the final stage of this closing operation the various propellant modules are forced to form a straight column one directly above the other. The hydraulic piston is thereafter activated and maneuvers the compacting heel 37 so that the latter is displaced against and presses the various propellant modules 20 together. The loading pendulum is then raised and is displaced sideways so that it lies in line with and above a flick rammer 38, shown in FIG. 1. The loading pendulum cradle 28 (which is journalled in the gun trunnion center) swings together with the loading pendulum to a position which corresponds to the gun elevation, and with the loading pendulum immediately above the flick rammer 38 intended for the propellant charge ramming. The propellant charge is then added to the flick rammer by means of the long sides of the loading pendulum being opened.

The two flick rammers 12 and 38 for shells and propellant charges, respectively, are in some ways of very similar design, but they nevertheless have certain pronounced distinguishing features. Each one thus includes its own loading trough 40 and 41, respectively, for shell and propellant charges, respectively. Each loading trough is provided at the bottom and along the side with locking wings 42 and 43, respectively, which are resilient about axles 42' and 43' and which make it possible to introduce shells and propellant charges, respectively, from above, but which prevent these from falling out during gun movements and at high elevations. The flick mechanisms which are necessary for the ramming, are to for all intents and purposes built into the flick housing 44 and 45, respectively, of the respective rammer.

The abovementioned difference between the two rammers is principally that the shell 7 is accelerated upon ramming up to ramming speed in its fixed loading trough 40, the supporting plate 46 being the point of contact between the shell and the flick mechanism. The shell 7 thus itself bridges, by means of its speed, the distance between the front edge of the loading trough and the loading opening of the barrel. In the case of the propellant charges 20, these are instead accelerated together with the loading trough 41 to the ramming speed, and the loading trough is quickly braked only when it has reached some distance into the loading opening of the barrel. As the loading trough is braked, the propellant charges 20 continue into the chamber position intended for this purpose in the gun, where they are blocked in a known manner against return.

The part of the complete installation which has not yet been described is how the rammers are brought into line with the barrel. According to the invention, this has been arranged in the following manner. The rammers 12 and 38 are both mounted so that they can be displaced sideways on a frame 47 which forms part of the gun elevation system. In the alternative shown in the figures, the sideways displacement movement is driven, for example, by a planetary screw 49 which is in turn driven by, for example, a hydraulic motor 48, electric motor or equivalent.

Other conceivable displacement mechanisms are, for example, a planetary screw which is driven by a hydraulic or electric motor, an appropriately driven gear rack or a simple hydraulic piston. The essential point is that the sideways displacement can take place very quickly and accurately.

According to the invention, the function sequences are as follows: In the starting position the loading troughs 40 and 41 of the flick rammers 12, 44 and 38, 45, respectively, are provided with shell 7 and propellant charges 20, respectively (in the case shown in FIGS. 3 and 4, the propellant charge is a charge consisting of six charge modules 20). The flick rammers are situated at their respective outermost positions in the frame 47. In this position, there is sufficient space between the rammers for the rear parts of the gun to be able to pass between them during recoil.

Figure 3:
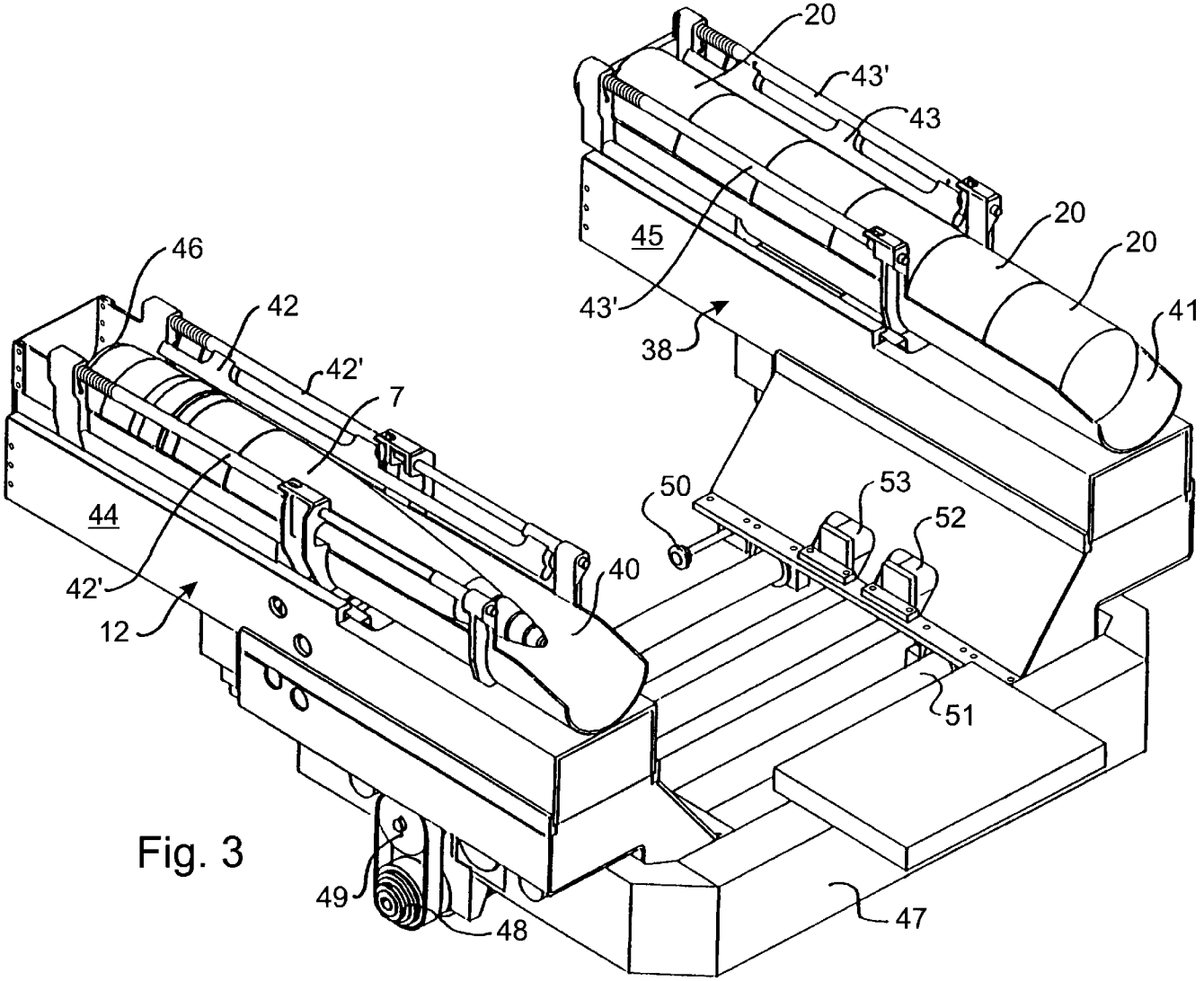
FIGS. 3 and 4 show, on a larger scale and in an oblique projection, the flick rammer of the gun, with the frame pertaining thereto.
Figure 4:
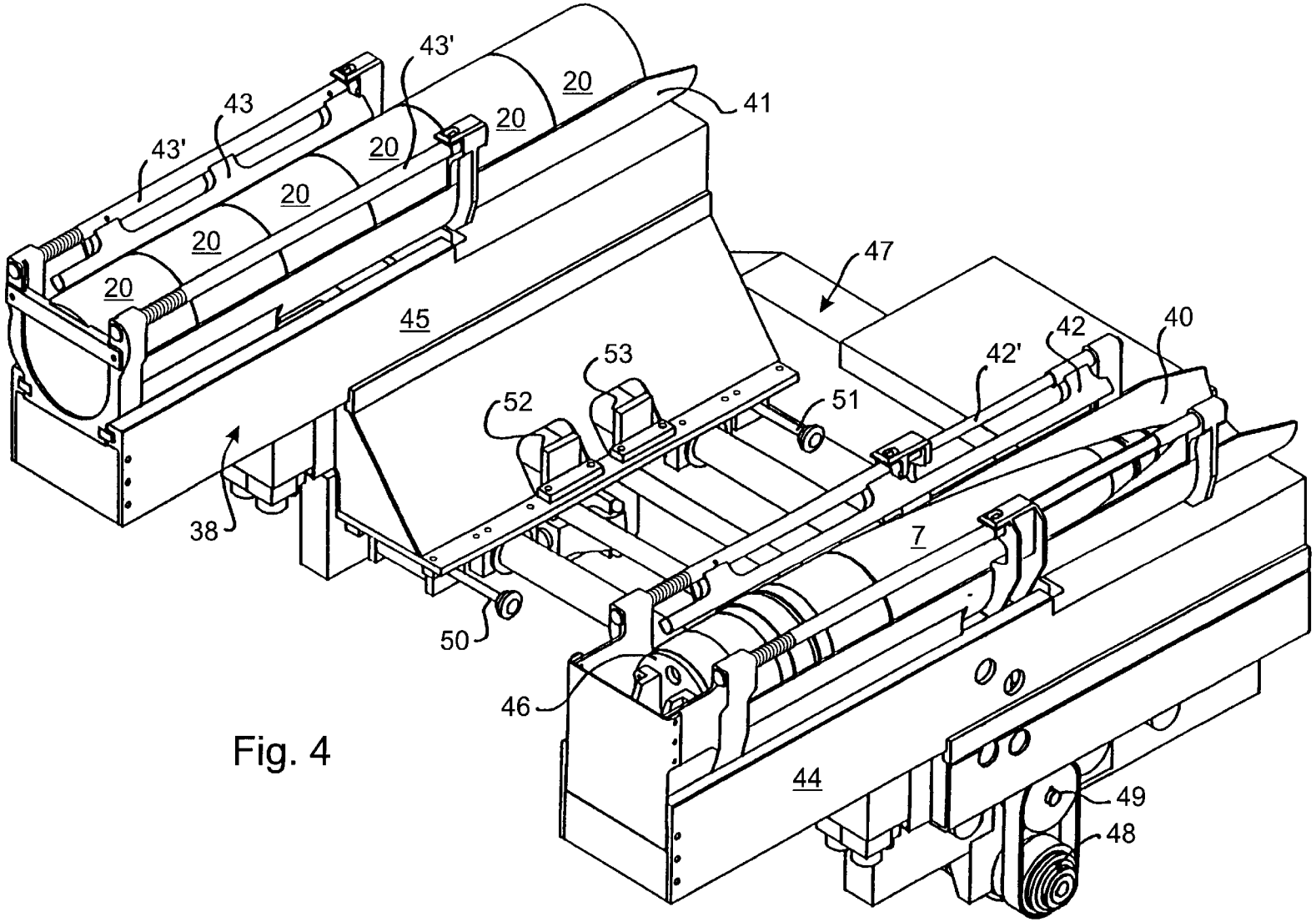

The loading of the gun is now commenced by means of the flick rammers 12, 38, 44, 45 being brought together at that side of the frame 47 where the flick rammer 38, 45 intended for ramming of the propellant charges has its outermost position. This gives the flick rammer 12, 44 intended for ramming of the shells 7 a position in which the shell 7 resting in its loading trough 40 is in line with the barrel 1, and it is in this position that its flick rammer function is activated, and the two flick rammers are thereafter displaced together towards the other side of the frame, which gives the flick rammer intended for ramming of the propellant charges a position in which a propellant charge 20 lying ready in its loading trough 41 is in line with the barrel 1, whereupon its flick rammer function is activated. The latter flick rammer is thereafter returned to its end position for supply of a new propellant charge, and as soon as it has reached this position, the gun is ready for firing. All the displacement movements take place at high speed, for which reason braking by means of buffers must take place at the respective end positions and when the rammers are brought together. Various buffers 50–53 are indicated in FIGS. 3 and 4.

We claim:

1. A method for loading artillery guns intended for non-cartridge ammunition by means of a pair of flick rammers including a first flick rammer for shells and a second flick rammer for propellant charges, said method comprising the steps of:

positioning said flick rammers at an end position in which said gun can recoil between said flick rammers and in which said flick rammers are loaded;

moving said first flick rammer, after it has been loaded, towards said second flick rammer to a position in which the shell in said first flick rammer is in line with a gun barrel;

activating said first flick rammer;

jointly displacing said flick rammers towards the opposite side of said gun barrel until said first flick rammer is in said end position and propellant charges in said second flick rammer is in line with said gun barrel;

activating said second flick rammer;

returning said second flick rammer to said end position.

2. The method according to claim 1 further comprising the steps of:

loading said propellant charges onto a loading trough associated with said second flick rammer;

upon activation of said second flick rammer, accelerating said loading trough together with said propellant charges towards and into said gun barrel;

braking said loading trough, such that said propellant charges continue into said gun barrel;

returning said loading trough to a starting position after said propellant charges have exited therefrom.

3. An apparatus for loading artillery guns with non-cartridge ammunition comprising:

a pair of flick rammers mounted in a frame to be parallel to a gun barrel, said frame being part of a gun elevation system, said flick rammers being individually and jointly moveable in parallel with each other from outermost positions, in which one flick rammer is arranged on each side of said gun a sufficient distance apart to allow recoiling parts of said gun to pass freely between said flick rammers, to an inner position where each flick rammer lies in line with said gun barrel one after the other.

4. The apparatus of claim 3 further comprising:

a member joining said flick rammers for sideways movement within said frame between said outermost positions and said inner position.

5. The apparatus of claim 4 wherein said members are adapted to hold said flick rammers together so they are displaced as a unit one after the other in line with said gun barrel and thereafter separated to return said flick rammers to their respective outermost positions.

6. The apparatus of claim 3 further comprising:

a first loading trough fixed to said flick rammer for said shells;

a second loading trough associated with said flick rammer for propellant charges, said second loading trough adapted to be accelerated towards said gun barrel;

braking members for braking said second loading trough, whereby said propellant charges continue into said gun barrel and said second loading trough returns to an initial position.

7. The apparatus of claim 4 further comprising:

a planetary screw for sideways displacement of said flick rammers, said screw being driven by one of the group comprising a hydraulic motor, an electric motor, a gear rack driven by an electric motor, a gear rack driven by a hydraulic motor, and a hydraulic piston.

* * * * *